US009845442B2

(12) United States Patent
Kozyuk et al.

(10) Patent No.: US 9,845,442 B2
(45) Date of Patent: Dec. 19, 2017

(54) METHOD FOR DEGUMMING VEGETABLE OIL

(71) Applicant: Arisdyne Systems, Inc., Cleveland, OH (US)

(72) Inventors: Oleg Kozyuk, North Ridgeville, OH (US); Peter Reimers, Shaker Heights, OH (US)

(73) Assignee: ARISDYNE SYSTEMS, INC., Cleveland, OH (US)

( * ) Notice: Subject to any disclaimer, the term of this patent is extended or adjusted under 35 U.S.C. 154(b) by 0 days.

(21) Appl. No.: 15/400,269

(22) Filed: Jan. 6, 2017

(65) Prior Publication Data

US 2017/0204349 A1 Jul. 20, 2017

Related U.S. Application Data

(60) Provisional application No. 62/280,250, filed on Jan. 19, 2016.

(51) Int. Cl.
*C11B 3/16* (2006.01)
*C11B 3/04* (2006.01)

(52) U.S. Cl.
CPC . *C11B 3/16* (2013.01); *C11B 3/04* (2013.01)

(58) Field of Classification Search
CPC ..... C11B 3/001; C11B 3/004; C11B 3/006; C11B 3/16
See application file for complete search history.

(56) References Cited

U.S. PATENT DOCUMENTS

| | | | | |
|---|---|---|---|---|
| 7,262,311 | B2 | 8/2007 | Christianson et al. | |
| 9,290,717 | B1 | 3/2016 | Kozyuk et al. | |
| 9,321,983 | B2 | 4/2016 | Kozyuk | |
| 9,340,749 | B1 | 5/2016 | Kozyuk et al. | |
| 9,410,109 | B1 | 8/2016 | Kozyuk | |
| 9,453,180 | B2 | 9/2016 | Kozyuk et al. | |
| 9,556,399 | B2 | 1/2017 | Kozyuk et al. | |
| 2005/0143590 | A1 | 6/2005 | Dawson | |
| 2009/0306419 | A1 | 12/2009 | Myong et al. | |
| 2009/0314688 | A1* | 12/2009 | Gordon | B01F 5/0644 208/223 |
| 2011/0003370 | A1* | 1/2011 | Gordon | B01F 5/0644 435/271 |
| 2013/0062249 | A1 | 3/2013 | Kozyuk et al. | |

OTHER PUBLICATIONS

The International Search Report and Written Opinion issued in corresponding International PCT Application No. PCT/US217/012480; dated Apr. 18, 2017.

* cited by examiner

*Primary Examiner* — Yate K Cutliff
(74) *Attorney, Agent, or Firm* — Pearne & Gordon LLP

(57) ABSTRACT

A hydrodynamic cavitation method for degumming triglyceride oil is used to increase oil yield and reduce impurities. The residence time of the oil for degumming in the cavitation field is reduced to enhance removal of impurities such as phosphorus without prolonged exposure of the oil to cavitation conditions. The mass transfer of impurities from an oil phase to non-oil components or water is carried out in a non-cavitational, mass transfer reactor positioned downstream of a hydrodynamic cavitation device. A separation step can be used to remove the phosphatides and other impurities from the treated oil to form a purified oil product.

20 Claims, 1 Drawing Sheet

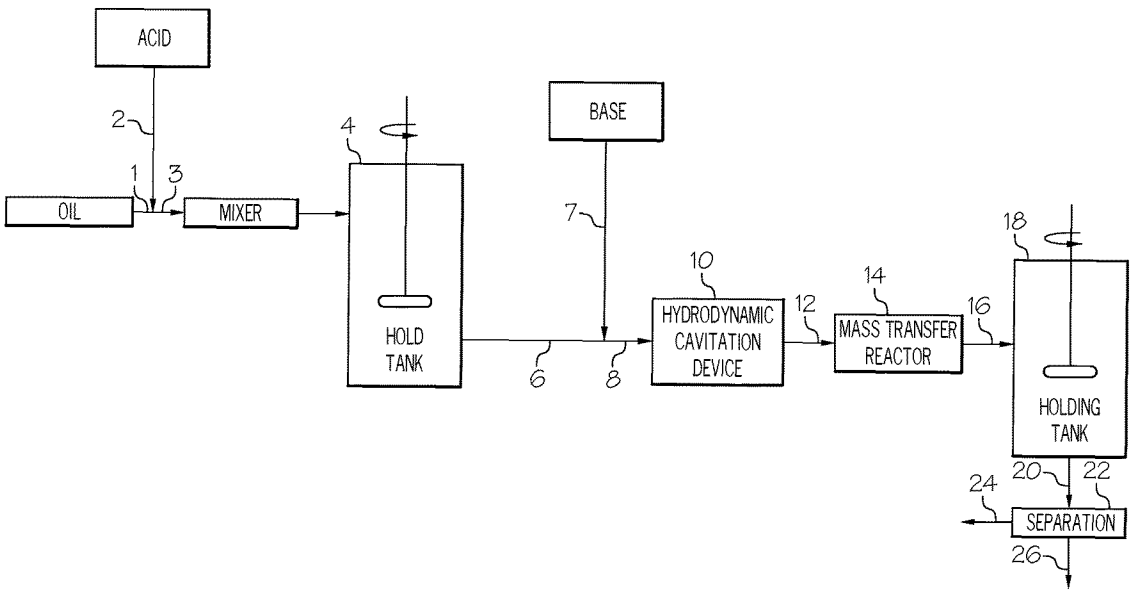
OIL
ACID
MIXER
HOLD TANK
BASE
HYDRODYNAMIC CAVITATION DEVICE
MASS TRANSFER REACTOR
HOLDING TANK
SEPARATION
1
2
3
4
6
7
8
10
12
14
16
18
20
22
24
26

METHOD FOR DEGUMMING VEGETABLE OIL

This is a continuation application that claims the benefit of U.S. provisional patent application Ser. No. 62/280,250 filed Jan. 19, 2016, the contents of which are incorporated herein in their entirety by reference.

FIELD

The invention relates to improved methods for refining oils, and more particularly, improved processes for degumming triglyceride oils having impurities.

BACKGROUND

Vegetable oil refining processes generally involve several steps including a degumming step which adds water to crude oil followed by heating and agitating the oil mixture for a period of time (e.g., 10-30 minutes) and at temperatures of typically 50 to 70° C. This mixture of hot oil and water is subjected to centrifugation wherein the water and oil are separated. In the process the hydrated phospholipids are separated with the water. The resulting partially degummed oil typically contains a quantity of phospholipids, including all the non-hydrated phospholipids. This quantity often contains the equivalent of 10 to 120 ppm of phosphorus; however, this quantity varies depending upon the precise degumming techniques and conditions used.

The partially degummed oil produced in accordance with the above process may be further degummed to remove the non-hydratable phospholipids by the addition of certain chemicals, such as phosphoric acid or base, and water and by again heating and agitating the mixture followed by centrifuging. The degummed oil produced from this step generally contains a quantity of phospholipids equivalent to 5 to 10 ppm of phosphorus.

Further improvements in degumming vegetable oils have been sought and, in particular, with regard to removing excess chemicals and further reducing the quantities of phospholipids and other impurities in the oil by using high shear mixing and cavitation.

A method disclosed in U.S. Pat. No. 4,240,972 includes adding an acid to a heated stream of crude vegetable oil and then immediately passing the mixture through a static mixer to produce an acid-in-oil dispersion having acid droplets smaller than 10 microns, and then separating the dispersion into an oil phase and an aqueous phase containing the phosphatides. This method claims that producing ultrafine acid droplets eliminates the need for lengthy acid-oil contact times and produces oil having a phosphorous level in range of 2 to 9 ppm.

U.S. Pat. No. 4,698,185 describes a vegetable oil refining method that includes the steps of finely dispersing an aqueous organic acid in a water-degummed oil to form an acid-in-oil dispersion, allowing the phases to remain in contact for a time sufficient to decompose metal salts of phosphatidic acid, adding a base to the acid-in-oil dispersion to increase pH to above 2.5 without substantial formation of soap, and finally separating the dispersion into an oil phase and an aqueous phase containing the hydrated phosphatides. The method typically utilizes 0.4 to 2 percent by weight of a 20 to 60 percent by weight organic acid solution and discloses a dispersion of at least 10 million droplets of aqueous acid per gram of oil. This refining method produces oil having a phosphorous level in range of 2 to 8.2 ppm.

U.S. Pat. No. 6,001,640 discloses oil degumming methods that use high-shear mixing. This degumming method produces oil having a phosphorous level in range 4.2 to 5.4 ppm. In another method, phospholipids can be removed from soybean oil by applying ultrasound cavitation and a small amount of degumming agent (Moulton, K. J., Mounts, T. L., "Continuous ultrasonic degumming of crude soybean oil", Journal of the American Oil Chemists' Society, 67, 1990, 33-38). This degumming method produces oil having a phosphorous level in range of 7 to 12 ppm.

Methods disclosed in U.S. Pat. Nos. 8,911,808 and 8,945,644 and U.S. Pat. App. Nos. 2014/0087042 and 2015/0057460 involve mixing vegetable oil with degumming agents, such as water or acid, and passing the mixture through a flow-through, hydrodynamic cavitation apparatus. The method generates cavitational features in the mixed fluid such that the impurities are directly transferred from the oil phase to the water phase during cavitation conditions. It was further disclosed that the concentration of phosphorus dropped to range of 2 to 10 ppm.

A disadvantage of these cavitational methods is that a mass transfer of impurities from the oil phase to the water takes place under the influence of cavitational features (i.e. formation and collapse of bubbles) and requires a long treatment cycle. Longer residence time in the collapsing cavitation bubbles can have an impact on the structural and functional components in the vegetable oils up to the point of lipid oxidation and deterioration due to hot spots attributed by cavitation. Oil produced from these degumming methods can be useful as a food product but still contains phospholipids, for example, equivalent to at least 2 to 10 ppm of phosphorus. No degumming process for vegetables oil is known which consistently delivers oil with less than 1 to 2 ppm of phosphorus. Accordingly, there is a continuing need for alternative refining methods, which can provide cost-effective removal of phosphorous below known achieved ranges and eliminate the disadvantages resulting from mass transfer in the cavitation bubble field.

SUMMARY

In a first aspect, there is a method for degumming an oil, the method includes a) mixing oil containing phospholipids with a reagent to form a pre-treated oil mixture;

b) passing the pre-treated oil mixture through a hydrodynamic cavitation device to form a field of hydrodynamic cavitation bubbles in the pre-treated oil mixture for reacting the phospholipids in the oil with the reagent, the pre-treated oil mixture being subjected to the field of hydrodynamic cavitation bubbles for residence time of less than $10\times10^{-5}$ seconds; wherein the reacted phospholipids remain in the oil of the pre-treated oil mixture such that the reacted phospholipids are not transferred to a water phase portion of the pre-treated oil mixture;

c) collapsing the hydrodynamic cavitation bubbles to form a processed oil mixture; and d) directing the processed oil mixture to a mass transfer, non-cavitational reactor, the reacted phospholipids being transferred from an oil phase in the processed oil mixture to a water phase in the processed oil mixture.

In some examples of aspect 1, the method further includes separating the water phase from the oil phase to form a purified oil.

In another example of aspect 1, the reacted phospholipids are not transferred from the oil prior to collapse of the hydrodynamic cavitation bubbles in the field.

In another example of aspect 1, the processed oil mixture is held in the mass transfer, non-cavitational reactor for at least 0.4 seconds. The mass transfer, non-cavitational reactor is directly downstream and in fluid communication with the hydrodynamic cavitation device and cavitation is suppressed.

In another example of aspect 1, the mass transfer, non-cavitational reactor is a static mixer, a pipe or a holding tank. The mass transfer, non-cavitational reactor is connected to outlet of the hydrodynamic cavitation device.

In another example of aspect 1, the method further includes repeating steps b) and c) at least once before step d) is carried out. Steps b) and c) can be repeated at least two, three or four times prior to carrying out step d).

In another example of aspect 1, the oil is a vegetable oil. The oil can be a crude vegetable oil or a water-degummed vegetable oil. The vegetable oil can be selected from the group of acai oil, almond oil, babassu oil, blackcurrent seed oil, borage seed oil, canola oil, cashew oil, castor oil, coconut oil, coriander oil, corn oil, cottonseed oil, crambe oil, flax seed oil, grape seed oil, hazelnut oil, hempseed oil, jatropha oil, jojoba oil, linseed oil, macadamia nut oil, mango kernel oil, meadowfoam oil, mustard oil, neat's foot oil, olive oil, palm oil, palm kernel oil, palm olein, peanut oil, pecan oil, pine nut oil, pistachio oil, poppy seed oil, rapeseed oil, rice bran oil, safflower oil, sasanqua oil, sesame oil, shea butter, soybean oil, sunflower seed oil, tall oil, tsubaki oil, walnut oil and combinations thereof.

In another example of aspect 1, the reagent can be selected from the group of water and an acid solution, for example, a water solution of phosphoric acid, hydrochloric acid, sulfuric acid, ascorbic acid, acetic acid, citric acid, fumaric acid, maleic acid, tartaric acid, succinic acid, glycolic acid, sodium hydroxide, potassium hydroxide, sodium silicate, sodium carbonate, calcium carbonate or combinations thereof.

In another example of aspect 1, the oil phase in the processed oil mixture can contain less than 2, 1.5, 1 or 0.8 ppm of phosphorus or have a phosphorus content of at least 98.5, 99.0 or 99.5 percent by weight less than the oil used in and to form the pre-treated oil mixture.

In a second aspect, there is a method for degumming an oil, the method includes a) mixing a vegetable oil containing phospholipids with a aqueous acid solution to form a pre-treated oil mixture that includes a water phase and an oil phase;

b) passing the pre-treated oil mixture through a local constriction in a cavitation device to form a field of hydrodynamic cavitation bubbles in the pre-treated oil mixture such that the phospholipids in the oil phase react with the aqueous acid solution, the pre-treated oil mixture being subjected to the field of hydrodynamic cavitation bubbles for residence time of less than $10\times10^{-5}$ seconds; wherein the reacted phospholipids in the field of hydrodynamic cavitation bubbles remain in the oil phase of the pre-treated oil mixture;

c) collapsing the hydrodynamic cavitation bubbles to form a processed oil mixture;

d) directing the processed oil mixture to a mass transfer, non-cavitational reactor, the reacted phospholipids being transferred from an oil phase in the processed oil mixture to a water phase in the processed oil mixture within the mass transfer, non-cavitational reactor; and e) separating the water phase from the oil phase in the processed oil mixture to form a purified oil, wherein the purified oil contains less than 2 ppm of phosphorus.

In some examples of aspect 2, the processed oil mixture is held in the mass transfer, non-cavitational reactor for at least 0.4 seconds.

In another example of aspect 2, the vegetable oil in the pre-treated mixture containing greater than 500 ppm of phosphorus.

In another example of aspect 2, the cavitation device is a static cavitation device and the local constriction is an orifice, baffle or nozzle.

In another example of aspect 2, the pre-treated mixture further includes a base. The base can be selected from the group of sodium hydroxide, potassium hydroxide, sodium silicate, sodium carbonate, calcium carbonate, and combinations thereof.

In another example of aspect 2, the processed oil mixture is held in the mass transfer, non-cavitational reactor for at least 0.4 seconds and the purified oil contains less than 1 ppm of phosphorus or has a phosphorus content of at least 98.5, 99.0 or 99.5 percent by weight less than the oil in the pre-treated oil mixture.

Any one of the above aspects (or examples of those aspects) may be provided alone or in combination with any one or more of the examples of that aspect discussed above; e.g., the first aspect may be provided alone or in combination with any one or more of the examples of the first aspect discussed above; and the second aspect may be provided alone or in combination with any one or more of the examples of the second aspect discussed above; and so-forth.

The accompanying drawing is included to provide a further understanding of principles of the disclosure, and is incorporated in and constitutes a part of this specification. The drawing illustrates some examples(s), and together with the description serves to explain, by way of example, principles and operation thereof. It is to be understood that various features disclosed in this specification and in the drawing can be used in any and all combinations. By way of non-limiting example the various features may be combined with one another as set forth in the specification, above, as aspects.

BRIEF DESCRIPTION OF THE DRAWINGS

The above and other features, examples and advantages of aspects of the examples disclosed in the present specification are better understood when the following detailed description thereof is read with reference to the accompanying drawing, in which:

FIG. 1 shows a block flow diagram of an oil degumming method using a hydrodynamic cavitation device and mass transfer reactor to reduce impurity levels in the oil being treated.

DETAILED DESCRIPTION

Herein, when a range such as 5-25 (or 5 to 25) is given, this means preferably at least 5 and, separately and independently, preferably not more than 25. In an example, such a range defines independently not less than 5, and separately and independently, not less than 25.

A method has been discovered for an efficient, cost-effective oil degumming process by use of a hydrodynamic cavitation device and non-cavitational, mass transfer reactor combination. The oil to be treated is pre-mixed with at least a reagent, e.g., an acid and water, and optionally a base, to form a pre-treated oil mixture. It has been found that by reducing the residence time of the pre-treated oil mixture in the field of cavitation bubbles formed in the cavitation device eliminates or substantially reduces mass transfer of phospholipids in the oil to non-oil components, for example a water phase, in the pre-treated mixture. The reduced residence time of the pre-treated oil mixture in the field of cavitation bubbles also reduces extended exposure of the oil to high temperatures generated in and surrounding the cavitation bubbles, which can result in lipid oxidation and oil deterioration. Increased impurity removal can be achieved by the methods of this disclosure.

As illustrated in the diagram of FIG. 1, one embodiment of a method for degumming oils can include multiple stages. As shown in the drawing, pipes, hoses, or other conventional, industrial equipment can be used to facilitate the fluid communication of the elements and streams discussed below.

Oil is shown as stream 1 in FIG. 1. The oils that can be degummed include vegetable oils, such as crude vegetable oil or water-degummed oil. Examples of vegetable oils can include, for example, acai oil, almond oil, babassu oil, blackcurrent seed oil, borage seed oil, canola oil, cashew oil, castor oil, coconut oil, coriander oil, corn oil, cottonseed oil, crambe oil, flax seed oil, grape seed oil, hazelnut oil, hempseed oil, jatropha oil, jojoba oil, linseed oil, macadamia nut oil, mango kernel oil, meadowfoam oil, mustard oil, neat's foot oil, olive oil, palm oil, palm kernel oil, palm olein, peanut oil, pecan oil, pine nut oil, pistachio oil, poppy seed oil, rapeseed oil, rice bran oil, safflower oil, sasanqua oil, sesame oil, shea butter, soybean oil, sunflower seed oil, tall oil, tsubaki oil, walnut oil or combinations thereof.

The phosphatide or phosphorus content of the oil 1 can be in the range of 30 to 1,200 ppm. The phosphatide content (or also referred to as phospholipid content), as used herein, is expressed as ppm phosphorus in oil. In an example, the phosphatide content of crude oil, such as vegetable crude oil, can be in the range of 200 to 1,200 ppm phosphorus. In another example, the phosphatide content of previously water-degummed oil, such as water-degummed vegetable oil, can be in the range of 30 to 200 ppm phosphorus.

The oil 1 can be heated prior to the degumming method (not shown), such as prior to acid being added to form an acid-treated oil. For example, the oil can be passed through a heat exchanger, such as a plate and frame heat exchanger, to increase or decrease the temperature of the oil as desired. The oil can be heated to a temperature in the range of 20 to 100° C., or at least to 30, 40, 50, 60, 70, 80, 90 or 100° C. Preferably, the oil is maintained at a temperature in the range of 40 to 95° C. during the degumming process as deemed suitable to one skilled in the art.

A reagent, for example an acid, such as an aqueous acid solution, can be added to the oil to be degummed to form a reagent oil mixture or an acid-treated oil 3. Acids can promote hydration of the non-hydrated phosphatides contained in the oil. The acid is shown as stream 2. The acid can include an inorganic or organic acid, for example, phosphoric acid, hydrochloric acid, sulfuric acid, ascorbic acid, acetic acid, citric acid, fumaric acid, maleic acid, tartaric acid, succinic acid, glycolic acid or a combination or mixture thereof. The acid is used in range from about 50 to 500 ppm as measured by weight of the oil. For example, a high concentration acid in water solution can be used, such as a 75 to 85 weight percent phosphoric acid water solution. In another example, the acid can be used in range from at least 0.02 to 0.2 percent by weight based on total weight of the oil in the acid-treated oil. Concentrated acid solutions, for instance, between 50 and 90 weight percent, can be used to reduce the amount of volume of acid solution being added. The aqueous acid solution can be stored in a working or holding tank prior to being added to the oil 1.

The acid-treated oil 3 can optionally be passed through a mixer to disperse the acid 2 in the oil 1. Any suitable mixer can be used, for example, the use of a dynamic mixer is preferred to disperse the acid in the oil. Using a dynamic mixer can provide more effective mixing and promote the use of concentrated acid solutions, which can reduce the volume of acid solution being added to the oil. Examples of mixers that can be used include centrifugal pumps or in-line mixers.

The acid-treated oil 3 can be optionally transferred to a holding or mixing tank 4. The tank 4 can store or further mix the acid-treated oil for a suitable predetermined amount of time. For example, the acid-treated oil can be held for a period of 1 minute to 24 hours. The tank can be equipped with a mixer or stirrer for maintaining a homogenous mixture. The tank can be jacketed or equipped with another heating apparatus, such as coils, for maintaining a desired holding temperature (not shown).

A base 7, such as in an aqueous base solution, can be added to and mixed with the acid-treated oil 6 to form a pre-treated oil mixture 8, for example before being passed through a first homogenization apparatus 10. The base 7 can be added to neutralize the acid-oil mixture, for instance, to bring the pH of the mixture to a range of 5 to 8, and preferably 6 to 7. The base can promote the neutralization of free fatty acids contained in the acid-oil mixture. The base 7 can be stored in a working or holding tank prior to being added to the acid-treated oil.

The base 7 can include sodium hydroxide, potassium hydroxide, sodium silicate, sodium carbonate, calcium carbonate, or combinations thereof. The base can be used in range from at least 0.02 to 0.2 percent by weight based on total weight of the oil in the acid-treated oil. Concentrated base solutions, for instance, between 30 and 50 weight percent, can be used to reduce the amount of volume of base solution being added. Optionally, dilute solutions of base, for example 5 to 20 weight percent, can be used. Beyond the stoichiometric amount of base required to neutralize the acid and free fatty acids in the acid-oil mixture, surplus base can be added, for example, to adjust for certain oils to be degummed and the quality thereof.

The pre-treated oil mixture 8, containing an oil phase and a water phase, is passed to a hydrodynamic cavitation device 10. The pre-treated oil mixture 8 can be fed to the apparatus 10 by a pump. Preferably, the pre-treated oil mixture 8 is fed to the apparatus 10 at a pre-determined inlet pressure, for example, in the range of 150 to 2,000 psi, or at least 200, 300, 400, 500, 600, 700 or 800 psi.

The device 10 can form a hydrodynamic cavitation field downstream of a local constriction in the device 10. The hydrodynamic cavitation field can contain cavitation bubbles. In general, cavitation can be described as the generation, subsequent growth and collapse of cavitation bubbles and cavities. During the collapse of the cavitation bubbles, high-localized pressures and temperatures are achieved, with some estimations of 5000° C. and pressure of approximately 500 kg/cm$^2$ (K. S. Suslick, Science, Vol. 247, 23 March 1990, pgs. 1439-1445). High temperatures and pressures can stimulate the progress of various chemical reactions which may not be possible under ordinary conditions, such as standard temperature and pressure, STP.

Therefore, a material may undergo physical changes under the influence of cavitation energy.

The local constriction in the hydrodynamic cavitation device 10 can be an orifice, baffle, bluff body or nozzle. The orifice can be any shape, for example, cylindrical, conical, oval, right-angled, square, etc. Depending on the shape of the orifice, this determines the shape of the cavitation fluid jets flowing from the localized flow constriction. The orifice can have any diameter, for example, the diameter can be greater than 0.1, 0.2, 0.3, 0.4, 0.5, 0.6, 0.8, 1, 2, 3, 5, or 10 mm, and preferably more less than 2, 1.5, 1 or 0.8 mm. In one example, the diameter of the orifice can be about 0.3 mm or about 0.4 mm. For multi-stage cavitation, two or more local constrictions, such as an orifices, can be in series, for example at least 2, 3, 4 or 5 orifices can be in series.

Preferably, the hydrodynamic cavitation device 10 is a static device that produces cavitation by passive means. Examples of static cavitational energy sources that can be used to apply cavitational energy to the pre-treated oil mixture include, but are not limited to, static mixers, orifice plates, perforated plates, nozzles, venturis, jet mixers, eductors, cyclonettes (e.g., Fluid-Quip, Inc.), and control flow cavitation devices (e.g., Arisdyne Systems, Inc.), such as those described in U.S. Pat. Nos. 5,810,052; 5,931,771; 5,937,906; 5,971,601; 6,012,492; 6,502,979; 6,802,639; 6,857,774 and 7,667,082.

The hydrodynamic cavitation field downstream of the local constriction is generated as the processing pressure of the pre-treated oil mixture is reduced after passing through the local constriction. Maintaining a pressure differential across the local constriction allows control of the cavitation intensity in the device 10. The pressure differential across the local constriction is preferably at least 150, 170, 200, 300, 400, 500, 600, 700, 800, 850, 900, or 1000, psi. Velocity of pre-treated oil mixture 8 through the local constriction in the cavitation device is preferably at least 1, 5, 10, 15, 20, 25, 30, 40, 50, 60 or 70 meters per second (m/s). The pressure drop in the pre-treated oil mixture 8 can be measured across the hydrodynamic cavitation device 10, which includes the pressure drop across all flow constrictions contained therein. The pressure drop in the pre-treated oil mixture across the hydrodynamic cavitation device can be in the range of 60 to 80 percent of the pre-determined inlet pressure to the device, or at least 65, 70 or 75 percent. In one embodiment, the pressure drop in the pre-treated oil mixture across the hydrodynamic cavitation device can be at least 100, 150, 200, 250, 300, 500 or 750 psi.

The cavitation bubbles formed by passing the pre-treated oil mixture 8 through the local constriction of the hydrodynamic cavitation device 10 are collapsed under the influence of static pressure. Energy emitted during collapse of the cavitation bubbles is directly proportional to magnitude of static pressure in surrounding liquid bubbles. Therefore, magnitude of the static pressure is directly related to energy emitted during cavitation bubbles collapse and better dispersion effect. The collapsing of the cavitation bubbles in the hydrodynamic cavitation field forms a process oil mixture 12.

The pre-treated oil mixture 8 can be passed through the hydrodynamic cavitation device 10 described herein as a single pass process or a multi-pass process to subject the pre-treated oil mixture to more than one hydrodynamic cavitation. For example, the steps of passing the mixture 8 through the device 10, forming a field of hydrodynamic cavitation bubbles and collapsing the bubbles can be repeated one, two, three or four times prior to transferring the processed oil mixture to a mass transfer reactor. To create a multi-pass cavitation process the pre-treated oil mixture 8 can be recycled repeatedly through the device via a recirculation loop. Alternatively, two or more hydrodynamic cavitation devices can be positioned in series to produce a multi-pass cavitation process.

The pre-treated oil mixture 8 can have a reduced residence time in the field of hydrodynamic cavitation bubbles. For example, the mixture 8 can have a residence time in the field of hydrodynamic cavitation bubbles of less than $10\times10^{-5}$ seconds, less than $9.5\times10^{-5}$ seconds, less than $9\times10^{-5}$ seconds, less than $8.5\times10^{-5}$ seconds, less than $8\times10^{-5}$ seconds, less than $7\times10^{-5}$ seconds, less than $6\times10^{-5}$ seconds, less than $5\times10^{-5}$ seconds, or less than $4\times10^{-5}$ seconds or less. Reduced residence time in the device 10 can be achieved by controlling velocity through the local constriction, downstream static pressure, or combinations thereof. Reduced residence time in the field of hydrodynamic cavitation bubbles can result in the phospholipids (e.g., reacted phospholipids) remaining in the oil of the pre-treated oil mixture and not transferring to other non-oil components of the pre-treated oil mixture. For example, limiting the pre-treated oil mixture 8 in the field of hydrodynamic cavitation bubbles to the above residence times can prevent and substantially reduce reacted phospholipids from transferring to a water portion or phase in the mixture 8 during cavitation.

The occurrence of long periods of time of cavitation in the pre-treated oil mixture can present disadvantages as discussed above. For example, cavitation methods can result in phospholipids not being removed from the oil in an amount of 2 to 10 ppm of phosphorus. These cavitation methods also rely on mass transfer taking place in the cavitation bubble field, which requires extended exposure of the oil to heat generated by cavitation. Longer residence time in the cavitation field can affect the structural and functional components in vegetable oils, for example, the extended exposure can result in lipid oxidation and deterioration. Thus, the removal rate of the impurities can decrease in the event of longer residence time of the oil in the cavitation field in the fluid. Reducing residence time of the oil and water phase in the field of hydrodynamic cavitation bubbles can avoid these problems and promote an increase in phospholipid removal as compared to cavitation methods.

Without being bound by any particular theory, it is believed that acid reacts with the non-hydratable phosphatides in the oil and decompose them. Because reagents (e.g., acid) can be diluted in an aqueous solution, such as an aqueous acid solution, a fine dispersion of the oil and reagent solution is desired. A fine dispersion is preferable when the reaction has to be near completion and low residual phosphatides and impurity content has to be reached, for example, below 2 ppm, 1.8 ppm, 1.5 ppm, 1.2 ppm, 1 ppm, 0.8 ppm or 0.5 ppm of phosphorus. Accordingly, the dispersion has to be so fine that the reaction between the acid and the non-hydratable phosphatides is almost instantaneous or at least almost completed within seconds. A fine dispersion is also needed for neutralization reaction with a base. As aqueous base droplets are finely dispersed, the interface area between the base and the oil and acid will increase, and diffusion distances will decrease, which will increase the overall neutralization reaction. Thus, when carrying out degumming process under the proposed conditions of reduced residence time in the cavitation field to avoid disadvantages of prolonged exposure to cavitation, its intensification occurs but not to the extent that a negative result in the increase in efficiency of impurity removal occurs.

The processed oil mixture 12 can be transferred to a mass transfer reactor 14. The reactor 14 can be directed connected to the hydrodynamic cavitation device 10 such that the outlet of the device 10 is in direct fluid communication with the inlet of the reactor 14. Preferably, the processed oil mixture 12 does not contain cavitation bubbles as it resides in the reactor 14. In one example, the reactor 14 is a non-cavitational reactor in that it does not contain a local constriction for forming cavitation bubbles. For instance, the mass transfer, non-cavitational reactor can be a static mixer, a pipe or a holding tank. Alternatively, the inlet pressure and pressure drop across the mass transfer reactor 14 is such that cavitation is suppressed completely. The pre-treated oil mixture 8 exits the hydrodynamic cavitation device 10 in stream 12 and enters a mass transfer reactor 14 at a second inlet pressure. The second inlet pressure of the pre-treated oil mixture 12 can be in the range of 20 to 1,000 psi, or at least 30, 50, 80, 100, 125 or 150 psi.

The mass transfer reactor provides a location for the phospholipids present in the oil to transfer to a water phase in the processed oil mixture 12. For example, the phospholipids that reacted with the reagent transfer from the oil to the water phase of the processed oil mixture during its residence time in the reactor 14. The residence time in the reactor 14 is sufficient to allow mass transfer of a significant portion of the phospholipids to the water phase. The residence time of the processed oil mixture 12 in the mass transfer reactor 14 can be at least 0.4 seconds, at least 0.6 seconds, at least 0.8 seconds, at least 1 second, at least 1.2 seconds, at least 1.4 seconds, at least 1.6 seconds, at least 1.8 seconds or at least 2 seconds or more. Mass transfer can occur under pressure in the reactor, for example, at a pressure of at least 30, 50, 80, 100, 120, 150, 200, 250 or 300 psi.

The processed oil mixture, which can contain an oil phase and a water phase, exits the reactor 14 as stream 16, or a treated oil mixture. Preferably, the oil phase of the processed oil mixture 16 has an enhanced phospholipid removal content level. In one example, the oil phase of the processed oil mixture 16 has a phosphorus content of less than 2 ppm, 1.8 ppm, 1.5 ppm, 1.2 ppm, 1 ppm, 0.8 ppm or 0.5 ppm of phosphorus. Oil mixture 16 can be further processed to prepare an oil product having a reduced amount of impurities. For example, the treated oil mixture 16 exiting the non-cavitational, mass transfer reactor 14 can be transferred to one or more separation phases to remove the added water, acid, base or other component or a portion thereof and impurities from the oil phase to create a purified oil product. Prior to separation, the treated oil mixture 16 can be transferred to a holding tank 18. The oil 16 can be mixed or allowed to rest in the holding tank as desired. From the holding tank, the treated oil 20, containing a water phase and an oil phase, can be processed to separate 22 the phases.

Separation of the water phase from the oil phase can be done with a decanter, centrifuge, hydrocyclone or similar separation equipment. The differences in densities of water and oil allows for a rapid and distinct separation of the two components. For example, if the separator is a gravity tank with a mixer or agitator, the residence time can be selected to allow for gravitational separation of the heavy phase and light phase as desired. Separation temperatures in a separation vessel can be adjusted as desired, for example, the separation temperature can be in the range of 20° C. to 150° C., 30° C. to 100° C. or 40° C. to 80° C. Preferably, the water and oil mixture can be introduced into a separation vessel at a temperature in the range of 20° C. to 60° C. From the separator 22, a water phase 24 and a purified oil 26 are formed. The purified oil 26 can be subjected to further processing steps known in the art including bleaching or deodorizing, as may be necessary or desirable depending on the end use for which the degummed oil product is intended.

The oil degumming methods described herein can be carried out at different temperatures, for instance, at any temperature deemed suitable by one of skill in the art. In certain embodiments, the temperature during the process is in the range from about 20° C. to 110° C. In certain embodiments, the temperature during the process is about 20, 30, 40, 50 60, 70, 80, 90, 100 or 110° C.

The purified oil 26 resulting from separation of water and impurities, such as soaps and phosphatides, has an improved quality. The phosphorus content of the purified oil can be less than 2 ppm, 1.8 ppm, 1.5 ppm, 1.2 ppm, 1 ppm, 0.8 ppm or 0.5 ppm, whereas the starting phosphatide or phosphorus content of the oil being fed to the hydrodynamic cavitation device can be in the range of 200 to 1200 for crude oils and 30 to 200 for water degummed oils. The degumming method described herein can result in a purified oil product having a reduction in phosphorus or phosphatide content of at least 98, 98.2, 98.5, 98.8, 99, 99.2, 99.4, 99.5, 99.6, 99.7, 99.8 or 99.9 weight percent, as compared to the oil being fed to the process or being used to form the pre-treated oil mixture.

In order to promote a further understanding of the invention, the following examples are provided. These examples are shown by way of illustration and not limitation.

EXAMPLE 1

250 g crude soybean oil with a residual phosphorus content of 585 ppm was heated to a temperature of approximately 80° C. 0.054% by wt. of concentrated (85 wt %) phosphoric acid was added to the heated oil, followed by 10 minutes of mixing with the magnetic stirrer at a speed of 300 rpm. The mixture was then placed into a hoper connected to a pump entrance and 1.57% by wt. of a dilute (9.52 wt %) caustic soda solution was added to the hoper and mixed with a 500 rpm speed agitator for 1 minute to create a pre-treated oil mixture. The pre-treated oil mixture was transferred from the hoper by the pump at a pressure 800 psi through a hydrodynamic cavitation device having a nozzle with a 0.4 mm opening to generate a field of hydrodynamic cavitation bubbles. The pre-treated oil mixture was passed through the cavitation device only once. The cavitation bubbles were collapsed in a mass transfer reactor positioned directly downstream of the cavitation device. The mass transfer reactor was an open pipe. Residence time in mass transfer reactor was controlled by pipe length. Duration of time of the pre-treated oil mixture in the field of the hydrodynamic cavitational bubbles was $8.0\times10^{-5}$ seconds, and residence time in the mass transfer reactor was 0.4 seconds. Processed soy bean oil was transferred to centrifuge vials and centrifuged at 900 RCF for 10 minutes. In the processed soy bean oil the phosphorus content dropped to 1.0 ppm, which is a reduction of at least 99.8%.

EXAMPLE 2

The same degummed soy bean oil from Example 1 was treated with same procedure. Only the residence time in the mass transfer reactor (pipe) was increased to 2.0 seconds in total. In processed soy bean oil, the phosphorus content was 0.8 ppm, which is a reduction of at least 99.86%.

EXAMPLE 3

250 g crude soybean oil with a residual phosphorus content of 540 ppm was heated to a temperature of approximately 80° C. 0.036% by wt. of concentrated (85 wt %) phosphoric acid was added to the heated oil, followed by 10 minutes mixing with the magnetic stirrer at a speed of 300 rpm. The mixture was then places into a hoper connected to a pump entrance and 1.38% wt. of a dilute (9.52 wt %) caustic soda solution was added to the hoper and mixed with a 500 rpm speed agitator for 1 minute to create a pre-treated oil mixture. The pre-treated oil mixture was transferred from the hoper by the pump with pressure 1,100 psi through a hydrodynamic cavitation device having nozzle with a 0.4 mm opening to generate a field of hydrodynamic cavitation bubbles. The pre-treated oil mixture was passed through the cavitation device only once. The cavitation bubbles were collapsed in a mass transfer reactor positioned directly downstream of the cavitation device. The mass transfer reactor was an open pipe. Residence time in mass transfer reactor was controlled by pipe length. Duration time of the pre-treated oil mixture in the field of the hydrodynamic cavitational bubbles was $3.6\times10^{-5}$ seconds, and residence time in the mass transfer reactor was 3.6 seconds. Processed soy bean oil was transferred to centrifuge vials and centrifuged at 900 RCF for 10 minutes. In processed soy bean oil, the phosphorus content dropped to 0.5 ppm, which is a reduction of at least 99.9%.

EXAMPLE 4

250 g crude soybean oil with a residual phosphorus content of 585 ppm was heated to a temperature of approximately 80° C. 0.054% by wt. of concentrated (85 wt %) phosphoric acid was added to the heated oil, followed by 10 minutes mixing with the magnetic stirrer at a speed of 300 rpm. The mixture was then places into a hoper connected to a pump entrance and 1.38% wt. of a dilute (9.52 wt %) caustic soda solution was added to the hoper and mixed with a 500 rpm speed agitator for 1 minute to create a pre-treated oil mixture. The pre-treated oil mixture was transferred from the hoper by the pump with pressure 400 psi through a hydrodynamic cavitation device having nozzle with a 0.4 mm opening to generate a field of hydrodynamic cavitation bubbles. The pre-treated oil mixture was passed through the cavitation device only once. The cavitation bubbles were collapsed in a mass transfer reactor positioned directly downstream of the cavitation device. The mass transfer reactor was an open pipe. Residence time in mass transfer reactor was controlled by pipe length. Duration time of the pre-treated oil mixture in the field of the hydrodynamic cavitational bubbles was $47.6\times10^{-5}$ seconds, and residence time in the mass transfer reactor was 0.4 seconds. Processed soy bean oil was transferred to centrifuge vials and centrifuged at 900 RCF for 10 minutes. In processed soy bean oil, the phosphorus content dropped to 12.4 ppm, which is a reduction of about 97.9%.

It will be understood that this invention is not limited to the above-described embodiments. Those skilled in the art having the benefit of the teachings of the present invention as hereinabove set forth, can effect numerous modifications thereto. These modifications are to be construed as being encompassed with the scope of the present invention as set forth in the appended claims.

What is claimed:

1. A method for degumming an oil comprising:

a. mixing oil containing phospholipids with a reagent to form a pre-treated oil mixture;

b. passing the pre-treated oil mixture through a hydrodynamic cavitation device to form a field of hydrodynamic cavitation bubbles in the pre-treated oil mixture for reacting the phospholipids in the oil with the reagent, the pre-treated oil mixture being subjected to the field of hydrodynamic cavitation bubbles for residence time of less than $10\times10^{-5}$ seconds; wherein the reacted phospholipids remain in the oil of the pre-treated oil mixture such that the reacted phospholipids are not transferred to a water phase portion of the pre-treated oil mixture;

c. collapsing the hydrodynamic cavitation bubbles to form a processed oil mixture; and d. directing the processed oil mixture to a mass transfer, non-cavitational reactor, the reacted phospholipids being transferred from an oil phase in the processed oil mixture to a water phase in the processed oil mixture.

2. The method of claim 1, further comprising separating the water phase from the oil phase to form a purified oil.

3. The method of claim 1, the reacted phospholipids are not transferred from the oil prior to collapse of the hydrodynamic cavitation bubbles.

4. The method of claim 1, the processed oil mixture being held in the mass transfer, non-cavitational reactor for at least 0.4 seconds.

5. The method of claim 1, the mass transfer, non-cavitational reactor being a static mixer, a pipe or a holding tank.

6. The method of claim 1, further comprising repeating steps b and c before step d is carried out.

7. The method of claim 1, the oil comprising a vegetable oil.

8. The method of claim 7, the vegetable oil being a crude vegetable oil or a water-degummed vegetable oil.

9. The method of claim 7, the oil being selected from the group consisting of acai oil, almond oil, babassu oil, blackcurrent seed oil, borage seed oil, canola oil, cashew oil, castor oil, coconut oil, coriander oil, corn oil, cottonseed oil, crambe oil, flax seed oil, grape seed oil, hazelnut oil, hempseed oil, jatropha oil, jojoba oil, linseed oil, macadamia nut oil, mango kernel oil, meadowfoam oil, mustard oil, neat's foot oil, olive oil, palm oil, palm kernel oil, palm olein, peanut oil, pecan oil, pine nut oil, pistachio oil, poppy seed oil, rapeseed oil, rice bran oil, safflower oil, sasanqua oil, sesame oil, shea butter, soybean oil, sunflower seed oil, tall oil, tsubaki oil, walnut oil and a combination thereof.

10. The method of claim 1, the reagent being selected from the group consisting of water and a water solution of phosphoric acid, hydrochloric acid, sulfuric acid, ascorbic acid, acetic acid, citric acid, fumaric acid, maleic acid, tartaric acid, succinic acid, glycolic acid, sodium hydroxide, potassium hydroxide, sodium silicate, sodium carbonate, calcium carbonate or a combination thereof.

11. The method of claim 1, the oil phase in the processed oil mixture containing less than 1 ppm of phosphorus.

12. The method of claim 11, the processed oil mixture being held in the mass transfer, non-cavitational reactor for at least 0.4 seconds.

13. The method of claim 1, the oil phase in the processed oil mixture containing less than 0.8 ppm of phosphorus.

14. A method for degumming an oil comprising:

a. mixing a vegetable oil containing phospholipids with a aqueous acid solution to form a pre-treated oil mixture comprising a water phase and an oil phase;

b. passing the pre-treated oil mixture through a local constriction in a cavitation device to form a field of hydrodynamic cavitation bubbles in the pre-treated oil mixture such that the phospholipids in the oil phase react with the aqueous acid solution, the pre-treated oil mixture being subjected to the field of hydrodynamic cavitation bubbles for residence time of less than $10\times10^{-5}$ seconds; wherein the reacted phospholipids in the field of hydrodynamic cavitation bubbles remain in the oil phase of the pre-treated oil mixture;

c. collapsing the hydrodynamic cavitation bubbles to form a processed oil mixture;

d. directing the processed oil mixture to a mass transfer, non-cavitational reactor, the reacted phospholipids being transferred from an oil phase in the processed oil mixture to a water phase in the processed oil mixture within the mass transfer, non-cavitational reactor; and e. separating the water phase from the oil phase in the processed oil mixture to form a purified oil, wherein the purified oil contains less than 2 ppm of phosphorus.

15. The method of claim 14, the processed oil mixture being held in the mass transfer, non-cavitational reactor for at least 0.4 seconds.

16. The method of claim 14, the vegetable oil in the pre-treated mixture containing greater than 500 ppm of phosphorus.

17. The method of claim 14, the cavitation device being a static cavitation device and the local constriction being an orifice, baffle or nozzle.

18. The method of claim 14, the pre-treated mixture further comprising a base.

19. The method of claim 18, the base selected from the group consisting of sodium hydroxide, potassium hydroxide, sodium silicate, sodium carbonate, calcium carbonate, and a combination thereof.

20. The method of claim 14, the processed oil mixture being held in the mass transfer, non-cavitational reactor for at least 0.4 seconds and the purified oil containing less than 1 ppm of phosphorus.

* * * * *